United States Patent [19]

Gundlach

[11] 4,064,514

[45] Dec. 20, 1977

[54] PORTABLE CAMERA

[75] Inventor: Robert W. Gundlach, Victor, N.Y.

[73] Assignee: Xerox Corporation, Stamford, Conn.

[21] Appl. No.: 538,678

[22] Filed: Jan. 6, 1975

[51] Int. Cl.[2] ..... G03G 15/22; G03G 15/00

[52] U.S. Cl. ..... 354/3; 355/3 R

[58] Field of Search ..... 355/3 CH, 3 R, 16, 17; 354/3; 96/1.5, 1 C; 250/324–326

[56] References Cited

U.S. PATENT DOCUMENTS

| | | | |
|---|---|---|---|
| 2,934,649 | 4/1960 | Walkup | 355/3 CH |
| 3,185,051 | 5/1965 | Goffe | 355/3 R |
| 3,684,364 | 8/1972 | Schmidlin | 355/3 CH |
| 3,713,820 | 1/1973 | Champ et al. | 96/1.5 |

*Primary Examiner*—L. T. Hix
*Assistant Examiner*—W. J. Brady
*Attorney, Agent, or Firm*—James Jay Ralabate; James L. O'Sullivan; John H. Faro

[57] ABSTRACT

A portable camera having the photosensitive member including an electrically conductive supportive substrate, a photoconductive layer overlying the substrate, and a leaky dielectric film overlying the free surface of the photoconductive layer. This camera is also provided with an electrically biased pad for contact charging of the photosensitive member and means for development of the photosensitive member within the camera subsequent to latent-image formation. Fixation of the developed image is achieved by overcoating said image with a permanent film or coating.

5 Claims, 10 Drawing Figures

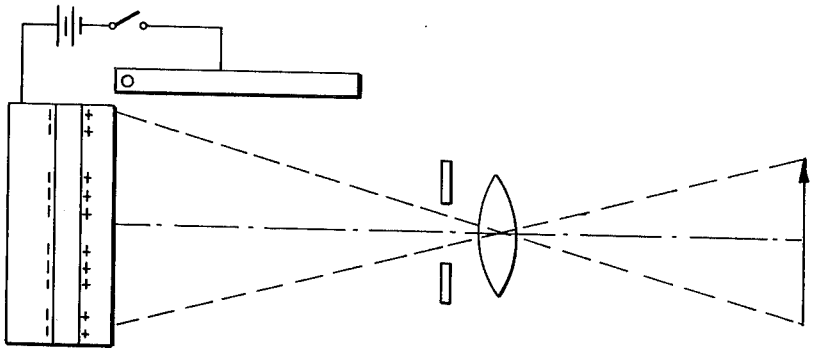
FIG. 7
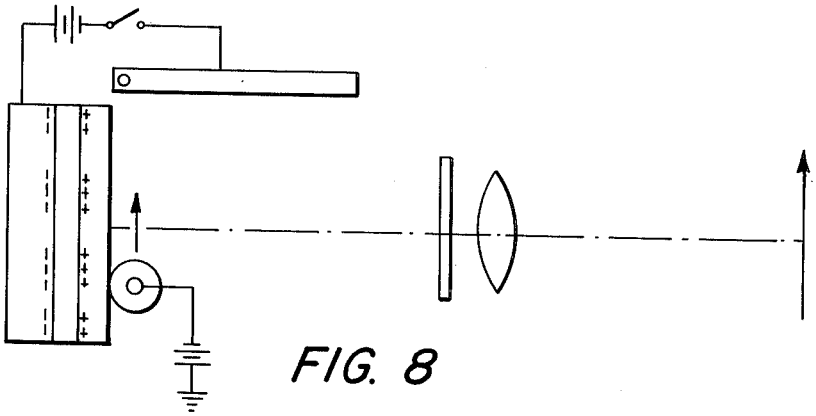
FIG. 8
FIG. 10
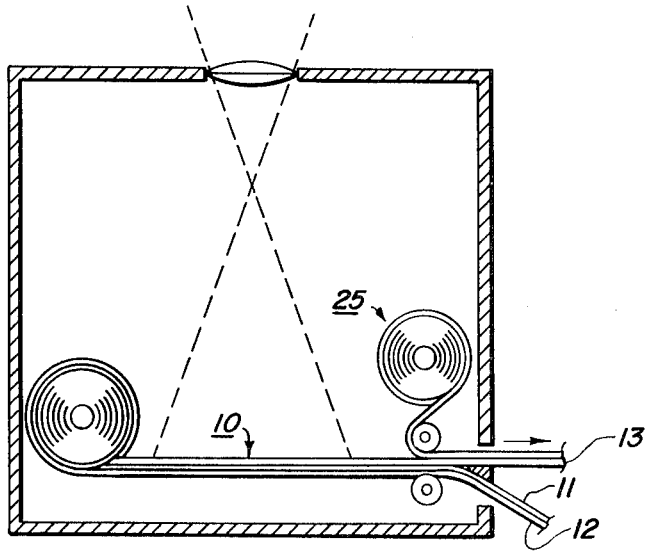

PORTABLE CAMERA

BACKGROUND OF THE INVENTION

1. Field of the Invention

This invention relates to a portable camera employing a consumable photosensitive recording medium and electrostatographic techniques in the preparation of line copy and/or reproduction having extended dynamic range. Image formation and development take place within the camera. The fixation of the developed image is achieved either within or outside the camera by overcoating the developed image on the recording surface of the photosensitive medium with a permanent supporting film or paper base followed by delamination of the recording layer of the photosensitive medium from the other components of said medium.

2. Description of the Prior Art

The formation and development of images on imaging layers of photoconductive materials by electrostatic means is well known. The best known of the commercial processes, more commonly known as xerography, involves forming a latent electrostatic image on the imaging layer of an imaging member by first uniformly electrostatically charging the surface of the imaging layer in the dark and then exposing this electrostatically charged surface to a light and shadow image. The light-struck areas of the imaging layer are, thus, rendered relatively conductive and the electrostatic charge selectively dissipated in these irradiated areas. After the photoconductor is exposed, the latent electrostatic image is rendered visible by development with finely divided colored electroscopic materials, known in the art as "toner". This toner will be principally attracted to those areas of the image-bearing surface, which retain the electrostatic charge and thus, form a visible powder image. The developed image can then be affixed to the photoreceptor (where the recording surface differs in color from the toner) or it can be transferred to a receiving member (preferably a sheet of untreated paper) and subsequently affixed thereto by solvent or thermal fusion techniques. Alternative methods of developed image fixation include overcoating of the developed image with transparent films or coatings or lamination of the recording surface to a permanent support film or paper, followed by stripping the recording surface from the photoreceptor structure.

The methods used in sensitization of the imaging surface of an imaging layer in electrophotography have been many and varied. In order to achieve acceptable copy quality, it is essential that the imaging layer be uniformly charged and that the magnitude of the charge be sufficient to enable formation of a latent image having sufficient conrast potential to be capable of development with electrophotographic developer materials. The most widely accepted technique for achieving this result is sensitization by one or more corona electrodes. Corona sensitization generally involves maintaining the corona electrode(s) at a potential of about 7000 volts (relative to ground) while simultaneously passing the photoconductor in close proximity to the electrode. The ionization of the air in the immediate vicinity of the corona electrode results in a cascade of charged air molecules onto the surface of the imaging layer of the photoconductor thereby imparting the desired degree of sensitization. The configuration of the electrode, its rate of travel and distance relative to the photoconductive insulating layer of the imaging member, must be carefully controlled in order to insure uniformity of potential and regularity in distribution of the surface charge. Slight surface irregularities in the photoconductive insulating layer do not adversely affect the ability of this type of charging system to uniformly blanket the imaging surface with a sensitizing charge, since the lands and valleys of the photoconductive insulating layer are equally accessible to the charged air molecules.

As is readily apparent, corona sensitization is not readily adaptble to a portable electrostatographic reproduction system insofar as the energy and voltage requirements of such a system far exceed that which is attainable where the source of energy is a battery.

One proposed alternative to corona sensitization is contact charging the surface of the photoreceptor by means of establishment of a physical junction between a source of electrical potential and the surface of the photoconductive insulating layer. This physical junction can be a biased roller or slightly conductive solution containing an electrolyte. Contact charging with biased rollers generally does not provide the imaging surface with a potential of sufficient magnitude to produce an acceptable, developable latent image. The principal reason for the inability of such contact charging to prove satisfactory is the inability to establish a sufficient number of point contacts between the biased roller and the surface of the photoconductive insulating layer.

Where the physical junction between the source of electrical potential and the imaging surface of the imaging layer is a low conductivity liquid (or an insulating liquid containing an electrolyte), sufficient point contact is no longer a problem since the entire photoreceptor surface is "wetted" with the charge carrying medium. Such liquid charging systems are, however, beset with the number of problems which are inherent in the use of liquids. For example, losses of the fluid by evaporation or by spilling are recurrent disadvantages. Furthermore, in the event that some electrolyte is lost from the charge-transfer medium by virtue of being transferred to the copy sheet or some other imbalance established within the solution, the conductivity of liquid will change and, thus, its ability to repeatedly impart the desired degree of sensitization. Both of the contact-charging systems described above do possess one inherent advantage over corona sensitization in that the power demands of these contact charging systems are substantially less.

Accordingly, it is the object of this invention to provide a portable reproduction system, which is compatible with electrophotographic imaging and development and fixing techniques.

More specifically, it is the primary object of this invention to provide a portable, electrophotographic camera wherein the photosensitive member can be uniformly sensitized by essentially liquid-free, contact charging techniques.

Another object of this invention is to provide a portable, electrophotographic camera wherein the photosensitive member comprises an overcoated panchromatic photoconductive composition.

Still another object of this invention is to provide a portable, electrophotographic camera wherein the latent image is developed within the camera with standard electrophotographic developer compositions.

Additional objects of this invention include the provision of an imaging method for utilization of the above camera and the reproduction created thereby.

SUMMARY OF THE INVENTION

The above and related objects are achieved by providing an electrophotographic camera wherein the photosensitive recording medium is capable of uniform sensitization by essentially liquid-free, contact charging techniques. This camera comprises a light-tight housing, an objective lens located at the front of the housing, a photosensitive recording medium disposed within the housing parallel to the image plane of the objective lens, means for sensitization of said photosensitive medium by contact-charging techniques, means for admission and exclusion of image information from impinging upon the photosensitive medium, means for development of the image information recorded on said photosensitive member and means for fixation of the recording surface of the photosensitive medium. In one of the preferred embodiments of the portable, electrophotographic camera of this invention, the contact charging means also serves as a development electrode for enhancing continuous toner rendition and solid area development.

BRIEF DESCRIPTION OF THE DRAWINGS

FIGS. 5–8 schematically represent an alternative configuration for charging, latent image formation and development of image information on the recording surface of a photosensitive recording medium.

FIG. 10 illustrates fixation techniques used in conjunction with the portable camera of FIG. 9.

DESCRIPTION OF THE INVENTION INCLUDING PREFERRED EMBODIMENTS

Figure 1:
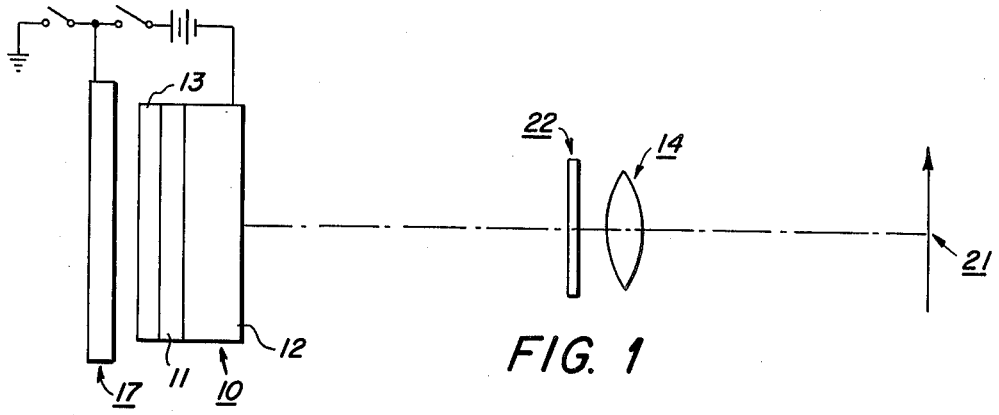
FIGS. 1–4 schematically represent the circuitry used in charging, latent image formation and development of image information on the recording surface of a photosensitive recording medium.

The photosensitive recording medium used in the portable camera of this invention comprises a conductive substrate, a photoconductive insulating layer of from about 15 to about 300 microns operatively disposed in relation to said substrate and a substantially continuous, leaky dielectric film overcoating said photoconductive insulating layer. In order to insure the formation of a good blocking contact between the photoconductive insulating layer and the dielectric film, an adhesive interface is preferably provided therebetween. This adhesive interface is formed from materials which are incapable of substantial alteration of the electrical properties of the surface of the photoconductive insulating layer. Such interface need only be thick enough to provide a substantially uniform film between the separated surfaces and sufficient adhesive bonding of one layer to the other in order to maintain the integrity of the recording medium. The adhesion of the overcoating to the underlying photoconductive insulating layer should not, however, be so great as to prevent subsequent delamination of the overcoating from the other components of the recording medium should the method selected for fixation of the developed image require such subsequent separation. The dielectric properties of the overcoating permits the uniform sensitization of the recording medium by essentially liquid-free, contact-charging techniques. So called "leaky" dielectric materials used in preparation of this overcoating are sufficiently conductive to permit injection and slight diffusion of the sensitizing charge to the common interface of the overcoating and the photoconductive layer and yet insulating enough to prevent extensive lateral migration of the sensitizing charge at the common interface of these two contiguous layers during the interval between imagewise exposure and development.

The electrophotographic imaging member of the type described hereinabove can be prepared by initially providing an appropriately preconditioned conductive substrate and depositing sufficient photoconductive materials on said substrate to provide a uniform and continuous coating having a thickness within the previously stated range. The dielectric film of said member can be laminated to the free surface of this photoconductive layer by application of an adhesive to the surface of the dielectric film, to the surface of photoconductive layer or to both surfaces. These layers are then pressure contacted with one another, the adhesive forming a bond therebetween along their contiguous surfaces.

The conductive substrate used in such imaging members can be either flexible or inflexible and can be selected from among any of the materials commonly used in preparation of electrophotographic imaging members. Typical of the materials which have proven suitable as substrates in such imaging members include aluminum, chromium, brass, stainless steel, their respective alloys, metallized plastic films, metal-coated plastic films, glass substrates having semiconductive oxide coatings (e.g. NESA glass, available from PPG Industries) and specially treated papers. In the event that the arrangement of the photosensitive member within the camera requires the projection of image information through the conductive substrate, then such substrate must be transmissive of such image information.

The photoconductive insulating layer of the imaging member described above can comprise a layer of amorphous selenium, such as selenium or selenium alloy, or a binder layer comprising photoconductive pigment dispersed in an insulating polymer resin. Alternatively, this photoconductive insulating layer can comprise an organic photoconductive polymer sensitized with an appropriate Lewis acid.

Representative of photoconductive pigments, which are suitable in binder layer photoreceptors, include cadmium sulfide, zinc oxide, cadmium sulfoselenide, selenium pigments, anthracene, phthalocyanine or any of the photoconductive organoselenium compounds. These pigments may be dispersed in a nonphotoconductive resin such as a polyester (e.g. Mylar, available from E. I. du Pont de Nemours & Co.); a polycarbonate (i.e. Lexan resin, available from General Electric Corp.); an acrylic (e.g. Lucite resins available from E. I. du Pont de Nemours & Co.); cellulose esters (e.g. cellulose acetate butyrate resins availble from Eastman Kodak Co.); vinylidine chloride/acrylonitrile copolymers (e.g. Saran type resins available from Dow Chemical Co.); poly(styrene) homopolymers and block copolymer of poly(styrene) and polysiloxane (e.g. available from Dow Corning Co.). Such photoconductive pigments may also be dispersed in photoconductive binders such as poly(vinylcarbazoles), poly(vinylpyrene) and other polymers wherein the polycyclic substituents are capable of rapid and efficient transport of photogenerated charge carriers. In the preferred embodiments of this invention, the photoconductive insulating layer comprises a mixture of pigments in order to insure rapid and efficient photoresponse throughout the entire visible band of the electromagnetic spectrum. In one such preferred embodiment of this invention, the photoconductive insulating layer comprises a mixture of cadmium sulfoselenide and phthalocyanine in a poly(N-vinylcarbazole) binder containing a small quantity (< 10 wt. %) of 2,4,7-trinitro-9-fluorenone.

In order to enhance the charge storage characteristics of an image member of the type described above, it is generally advisable that the surface of the conductive substrate be pretreated or coated so as to prevent dark injection of charge carriers from said substrate into the photoconductive insulating layer, (typical treatments being taught in U.S. Pat. No. 2,901,348 to Dessauer et al).

After having formed the photoconductive insulating layer on the conductive substrate, the free surface of such photoconductive insulating layer is further overcoated with a leaky dielectric film having a range of thickness within defined limits, a bulk resistivity in the range of from about $10^{12}$ to about $5\times10^{14}$ ohm-cm and a surface resistiviy of from about $4\times10^{14}$ to about $2\times10^{17}$ ohms per square. The ratio of thickness of this overcoating to the photoconductive insulating layer can range from about 0.1:1 to about 1:1. In order to insure good physical contact between the leaky dielectric overcoating and the photoconductive insulating layer, a thin adhesive film is interposed therebetween. This adhesive (as indicated previously) can be coated on either the photoconductive layer, the dielectric film or the contiguous surfaces of each prior to lamination. It is generally preferred that the electronic properties of the adhesive interface be similar to those of the overcoating for obvious reasons. The failure to establish substantially complete and uniform contact between the photoconductive insulating layer and the leaky dielectric overcoating can result in incomplete and irregular discharge of the sensitizing charge and, thus, poor image quality. The adhesive materials should be sufficient to provide good bonding of the two layers; however, in the preferred embodiments of this invention, such adhesive bond should not be permanent in nature in the sense that it can preclude subsequent separation of the photoconductive layer and the leaky dielectric overcoating. Adhesive materials which are suitable for use in bonding of the photoconductive insulating layer to the leaky dielectric film include sucrose diacetate, hexaisobutyrate, silicone oil, high molecular weight petroleum derived viscous lubricants, Vista wax (available from S. C. Johnson and Co.) and silicone base stopcock greases.

The leaky dielectric overcoating can either be precast as a thin sheet or film and laminated to the photoconductive layer with an adhesive, or it can be formed directly on the adhesive coated photoconductive insulating layer. Materials which are suitable for use in this dielectric overcoating include the following:

Tedlar (DuPont's polyvinylfluoride): $\rho\approx10^{13}$ to $10^{14}$
vinyl chloride: $\rho = 10^{11}$ to $10^{15}$
vinyl chloride/vinyl acetate copolymer: $\rho = 10^{11}$ to $10^{15}$
urethane elastomer: $\rho = +2\times10^{11}$ to $1\times10^{13}$
styrene/butadiene elastomer: $\rho = 5\times10^{13}$ to $2.5\times10^{16}$ (a bit too high unless doped)
phenolic resin: $\rho = 4.3\times10^{13}$
phenoxy resin: $\rho = 10^{10}$ to $10^{13}$
Nylon II: $\rho = 4.3\times10^{13}$
epoxy: $\rho = 10^{12}$ to $10^{14}$
cellulose acetate: $\rho = 10^{11}$ to $10^{14}$
ethyl cellulose: $\rho = 10^{12}$ to $10^{14}$ In the event that the stated resistivity ($\rho$) of the listed material is somewhat in excess of the limit specified for the overcoating, its dielectric properties can be modified by the addition thereto of materials which reduce its insulating capacity. Additives which are known to achieve this result include certain quaternary ammonium salts, p-chloranil, and tetracyanoethylene triphenylamine.

Figure 2:
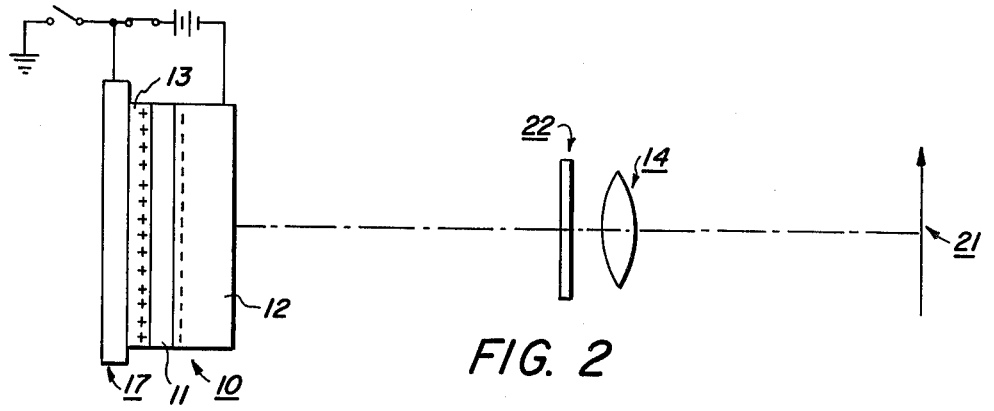
Figure 3:
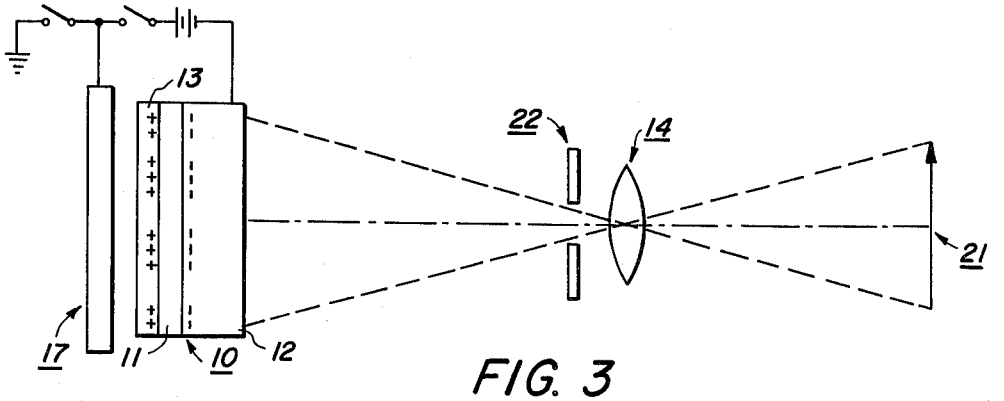
Figure 4:
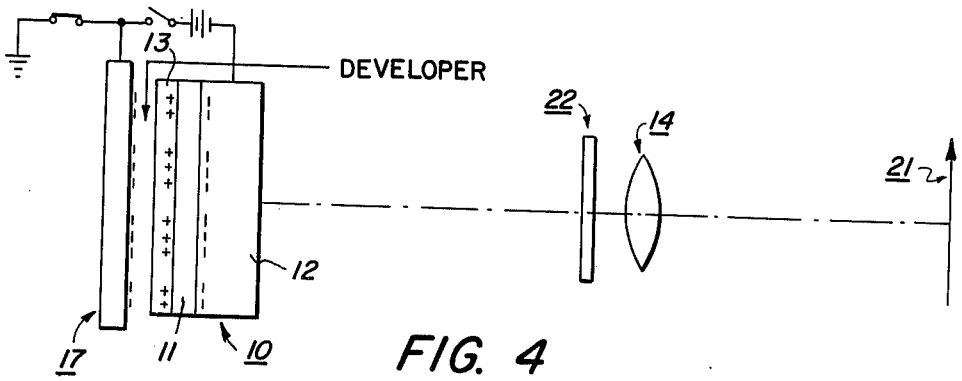
Figure 5:
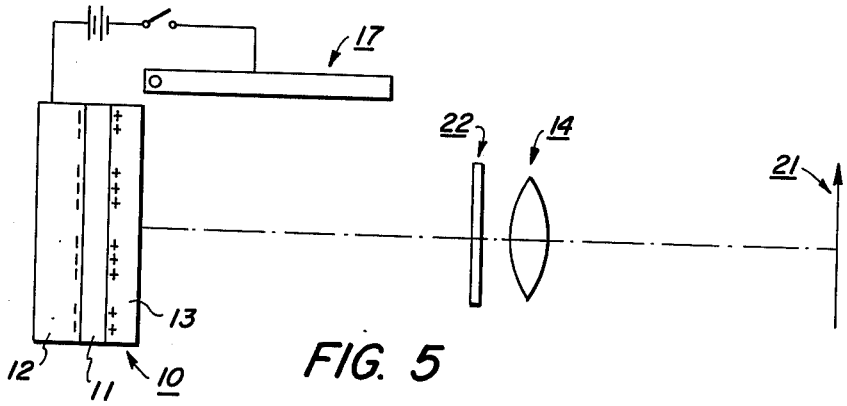
Figure 6:
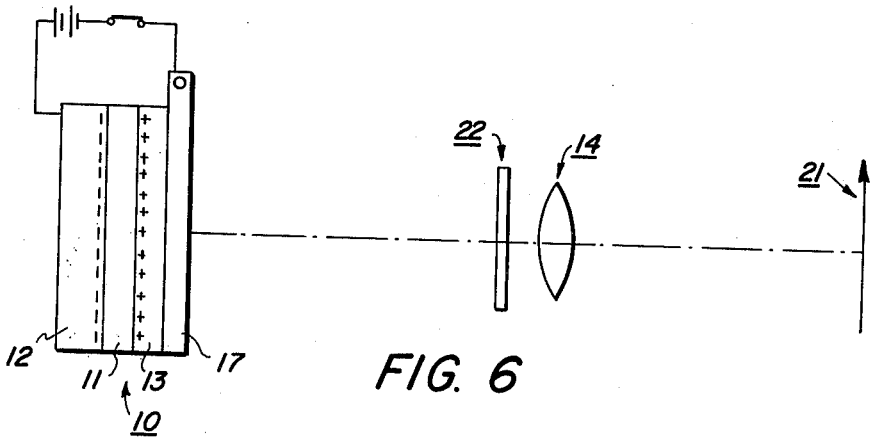

Referring now briefly to the sequence of drawings (FIGS. 1–4 and 5–8) accompanying this disclosure in which is shown a photosensitive recording medium of the type described above and the method by which it is sensitized, imaged and developed. In FIGS. 1 and 5 are illustrated a photosensitive member 10 comprising a panchromatic photoconductive layer 11 sandwiched between a transparent substrate 12 and leaky dielectric film 13. This photosensitive medium is located parallel to the image plane of lens 14 in order to permit uniform focusing. In FIG. 1 the recording surface of the dielectric overcoating faces away from the source of image information whereas in FIG. 5 the recording surface of the dielectric layer is oriented toward the source of image information. Prior to exposure of the photosensitive member to image information, the photosensitive member is sensitized by contacting its dielectric overcoating with an electrically biased pad 17 as shown in FIGS. 2 and 4. Following a brief period of contact (approximately 1 to 5 seconds) between the biased pad of a dielectric overcoating, the two elements are separated slightly and image information 21 projected through lens 14 and shutter 22 onto the photosensitive member as illustrated in FIGS. 3 and 7. Shutter 22 is then closed and the image information developed by cascading toner particles over the surface of the dielectric layer (FIG. 4) or by liquid development (FIG. 8). As shown in FIG. 4, the bias on the conductive pad has been reversed by grounding in order to enhance solid density development. Similarly, the developer applicator of FIG. 8 is biased for the purpose of enhancing image resolution.

Figure 9:
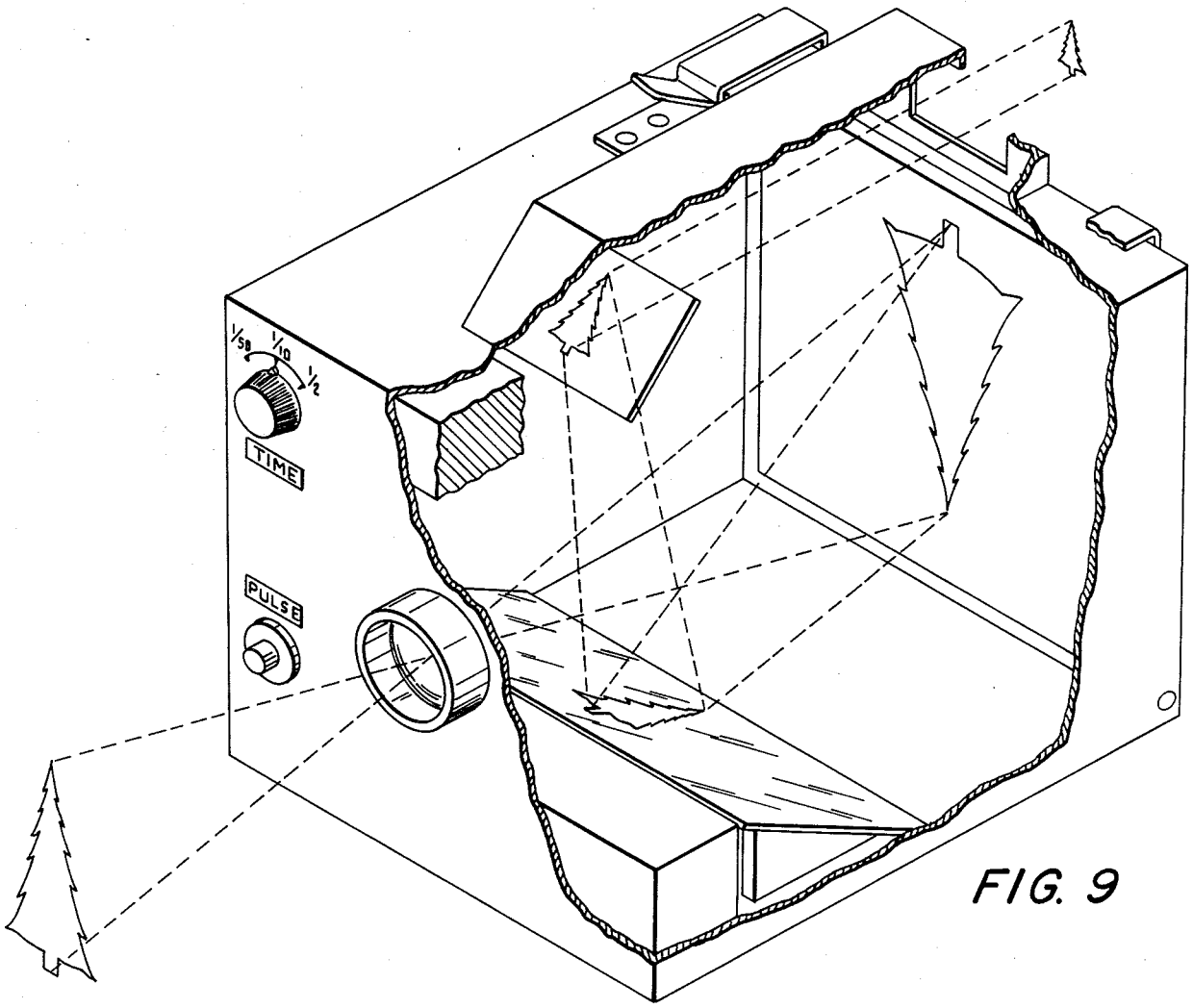
FIG. 9 is an exploded view of a portable camera of this invention.

FIG. 9 is an exploded view of a portable camera employing the aforedescribed imaging system. The power supply for charging of the photosensitive member can be located within the camera or attached through a standard PC cord to a portable battery pack.

The uniformity of sensitization of the photoconductive layer of the photosensitive member is dependent upon four factors, all of which are interrelated; (a) the thickness of the leaky dielectric layer, (b) the dielectric relaxation time constant for charge migration within the leaky dielectric layer, (c) the frequency of point contacts between the source of charge carriers and the leaky dielectric overcoating and (d) the duration of the interval between sensitization and imagewise exposure. By insuring that the average distance between the point contacts of the charging means and the surface of the overcoating is less than three times the thickness of the overcoating, charge injected by the charging means into the leaky dielectric overcoating will have sufficient opportunity to migrate and diffuse laterally as it migrates to the common interface of the overcoating and the photoconductive layer within the time specified, thereby uniformly sensitizing the underlying photoconductive insulating layer prior to imagewise exposure.

In operation of the camera shown in FIG. 9, the photosensitive medium is arranged relative to the objective lens in the same manner shown in FIGS. 1–4. Initially, a conductive pad (not shown) is brought in contact with the surface of the dielectric overcoating and allowed to remain in contact therewith for any-where from about 1 to 5 seconds. It is generally preferred that such charging immediately precede exposure; otherwise the potential imparted to the photosensitive medium may dark discharge with the elapse of an extended period of time depending upon the resistivity of the photoconductive layer and, thus, the contrast potential resulting from subsequent exposure will be insufficient to enable satisfactory development of the image pattern. Following sensitization, the conductive pad and photosensitive medium are separated and image information projected onto the photoconductive layer as shown in FIG. 2. Subsequent to exposure of the photosensitive medium, the charge pattern produced thereby is rendered visible by development with toner materials. This is achieved simply by tumbling a developer composition containing charged toner particles over the surface of the dielectric overcoating. During development, the conductive pad used in sensitization is maintained at ground or near zero potential and, thus, acts as a development electrode. Developers can be dispensed from a container within the camera or can be dispensed from a receptacle located outside the camera. Developer materials are collected and can be replenished with toner to develop subsequent images. Following development of the image pattern on the recording surface of the dielectric overcoating of the photosensitive medium, the toned surface of the dielectric coating is brought in contact with an adhesive coated sheet 25. This can be achieved either within the camera (FIG. 10) or subsequent to removal of the developed photosensitive medium from the camera. Following contact of the adhesive sheet and the developed image, the dielectric overcoating/photoconductive layer bond is severed and the dielectric sheet and the photoconductor separated from one another. Since the dielectric overcoating is substantially colorless, the developed image is readily visible through this overcoating. Where the adhesive sheet laminated to this dielectric overcoating is also transparent, the resulting image can be projected as a transparency. Where the adhesive sheet is paper or other opaque material, the image is viewed as a reflection copy. Overcoating of the toned surface of the dielectric with an adhesive coated film eliminates the need for fixation of the developed image with heat or solvent vapors. Moreover, because all of the developed image is retained on the recording surface of the dielectric overcoating, the density of the reproduction corresponds to the density of the image subsequent to development. Variations in image density are very noticeable in the preparation of reproduction of images having large solid areas, and especially medium gray tones. The portable reproduction system of this invention is superior to electrostatographic recordings prepared by conventional transfer of the developed image from the recording surface of a photosensitive member to a receiving sheet, since invariably such transfers are always somewhat incomplete. Because of this exact correspondence in image density between the developed image and the final copy, the continuous tonal quality of the reproductions in the present invention are excellent, being limited only by the dynamic range of the photosensitive recording medium and the inherent sensitivity of the development method.

What is claimed is:

1. In a portable electrophotographic camera comprising:

a. a light tight housing;

b. an objective lens;

c. a leaky dielectric overcoated consumable photosensitive recording medium located within the light tight housing and disposed parallel to the image plane of the lens said medium comprising a conductive substrate, a photoconductive insulating layer of from about 15 to about 300 microns in thickness operatively disposed in relation to said substrate and a leaky dielectric overcoating layer, wherein the ratio of thickness of said overcoating layer to said photoconductive insulating layer is from about 0.1:1 to about 1:1;

d. means for admission and exclusion of image information from impinging upon the photosensitive recording medium; and e. means for developing the image information recorded on said photosensitive member, the improvement comprising:

means for essentially liquid free contact charging the recording surface of the leaky dielectric overcoating of the photosensitive recording medium, the frequency of point contact of the charging means with the surface of the leaky dielectric overcoating being approximately three times the thickness of said overcoating or less.

2. The portable camera of claim 1, wherein the camera also contains means for lamination of an adhesive sheet to the recording surface of the leaky dielectric overcoating of the photosensitive medium subsequent to the development of image information on the recording surface of said medium.

3. The portable camera of claim 2, wherein the camera also contains means for delamination of the leaky dielectric overcoating from the other components of the photosensitive recording medium.

4. The portable camera of claim 1, wherein the adhesive sheet is transparent.

5. The portable camera of claim 1, wherein the adhesive sheet is opaque.

* * * * *